US009694938B2

(12) United States Patent
Hollis et al.

(10) Patent No.: US 9,694,938 B2
(45) Date of Patent: Jul. 4, 2017

(54) COLLAPSIBLE RECEPTACLE

(71) Applicants: John Rey Hollis, Berkeley, CA (US); Christine Ann Hollis, Berkeley, CA (US); Roger G. Carr, Berkeley, CA (US)

(72) Inventors: John Rey Hollis, Berkeley, CA (US); Christine Ann Hollis, Berkeley, CA (US); Roger G. Carr, Berkeley, CA (US)

(73) Assignee: Design Fold LLC, Berkeley, CA (US)

( * ) Notice: Subject to any disclaimer, the term of this patent is extended or adjusted under 35 U.S.C. 154(b) by 10 days.

(21) Appl. No.: 14/958,628

(22) Filed: Dec. 3, 2015

(65) Prior Publication Data

US 2016/0159518 A1 Jun. 9, 2016

Related U.S. Application Data

(60) Provisional application No. 62/087,783, filed on Dec. 4, 2014.

(51) Int. Cl.
*A47G 19/22* (2006.01)
*B65D 21/08* (2006.01)
(Continued)

(52) U.S. Cl.
CPC ..... *B65D 21/086* (2013.01); *A45F 3/20* (2013.01); *A47G 19/2205* (2013.01);
(Continued)

(58) Field of Classification Search
CPC ..... B65D 21/086; A47G 2019/2277; A47G 19/2205; A45F 3/20; A45F 2003/205
(Continued)

(56) References Cited

U.S. PATENT DOCUMENTS 1,025,380 A 5/1912 Curtis et al.
1,356,995 A 10/1920 Mayer
(Continued)

OTHER PUBLICATIONS

United States Patent & Trademark Office, International Search Report and Written Opinion,PCT/ISA/220, Application No. PCT/US2015/063784, Feb. 11, 2015, U.S. Patent & Trademark Office, Alexandria, VA.

(Continued)

*Primary Examiner* — Stephen Castellano
(74) *Attorney, Agent, or Firm* — Thomas P. O'Connell; O'Connell Law Firm

(57) ABSTRACT

A collapsible receptacle, such as a beverage cup, that is reconfigurable between expanded and collapsed configurations with an inner sleeve with first and second opposed major walls divided by opposed fold lines, an outer sleeve with first and second opposed major walls divided by opposed fold lines, and a liner retained by the inner and outer sleeves. The receptacle is retained in an expanded configuration when the opposed fold lines of the inner and outer sleeves are not aligned, and the receptacle can be collapsed when the opposed fold lines are aligned. A lid can be removably retained by a retaining ring. The opposed fold lines of the inner and outer sleeves can be disposed in groups, such as groups of two fold lines, so that the sleeves have opposed minor walls. The major walls can taper in thickness from their mid-portions to the opposed fold lines.

27 Claims, 10 Drawing Sheets

(51) Int. Cl.
*B65D 43/02* (2006.01)
*A45F 3/20* (2006.01)

(52) U.S. Cl.
CPC ..... *B65D 43/02* (2013.01); *A45F 2003/205* (2013.01); *A47G 2019/2277* (2013.01)

(58) Field of Classification Search
USPC ..... 220/666
See application file for complete search history.

(56) References Cited

U.S. PATENT DOCUMENTS 1,426,916 A 8/1922 Schorpp
1,530,256 A 3/1925 Garland
1,690,586 A 11/1928 Main et al.
2,234,065 A 3/1941 Vogt
2,382,573 A 8/1945 Moore
2,402,944 A 7/1946 Braloff
2,853,222 A 9/1958 Gallagher
3,003,678 A 10/1961 Chase
3,136,475 A 6/1964 Geimer
3,184,149 A 5/1965 Repko
3,220,544 A * 11/1965 Lovell ..... A61J 7/0046 206/218
3,285,459 A 11/1966 Gahin
3,363,750 A 1/1968 Smith
3,372,859 A 3/1968 Johansson
3,373,917 A 3/1968 Cox
3,375,969 A 4/1968 Davis
3,437,258 A 4/1969 Kugler
3,521,807 A 7/1970 Weisberg
3,565,244 A 2/1971 Wakefield
3,604,491 A 9/1971 Spiess
3,640,381 A 2/1972 Kanada et al.
3,659,777 A 5/1972 Kanada et al.
3,684,156 A 8/1972 Fettinger et al.
3,684,157 A 8/1972 Mendez et al.
3,939,887 A 2/1976 Scarnato
4,196,034 A 4/1980 Kimura
4,257,535 A 3/1981 Mellett
4,284,205 A 8/1981 Hirata
4,391,366 A 7/1983 Hirata
4,408,644 A 10/1983 Svantesson
4,428,500 A 1/1984 Kohler
4,491,220 A 1/1985 Daviss
4,530,480 A 7/1985 Pratt
4,620,631 A 11/1986 Bartelt
4,792,086 A 12/1988 Chen
4,854,474 A 8/1989 Murray et al.
4,867,374 A 9/1989 Murray et al.
4,895,135 A 1/1990 Hamasaki
4,940,138 A 7/1990 Hornstein
4,941,754 A 7/1990 Murdock
5,101,996 A 4/1992 Mosley
5,132,124 A 7/1992 Tamaki et al.
5,188,261 A 2/1993 Butters
5,213,253 A 5/1993 Fantoni et al.
5,244,108 A 9/1993 Hale
5,255,808 A 10/1993 Tobler
D345,673 S 4/1994 Dark
5,460,324 A 10/1995 Vinther
5,478,152 A 12/1995 Bogle
5,575,398 A 11/1996 Robbins
5,588,552 A 12/1996 Johnson
D381,558 S 7/1997 Schaeffer et al.
5,842,634 A 12/1998 Kieler
6,126,010 A 10/2000 Kogen
6,227,439 B1 5/2001 Hansen
6,260,756 B1 7/2001 Mochizuki et al.
6,488,170 B1 12/2002 Johnson
6,508,587 B1 1/2003 Byers
6,527,169 B2 3/2003 Kim
6,666,329 B1 12/2003 Charbonneau
6,702,143 B2 3/2004 Wang
6,736,285 B2 5/2004 Stewart-Stand
7,128,934 B1 10/2006 Ohta et al.
7,347,623 B2 3/2008 Cawley
D580,799 S 11/2008 Curtin
7,604,155 B2 10/2009 Bossel et al.
7,757,881 B1 7/2010 Riley
7,882,737 B2 * 2/2011 Coats ..... B65D 5/103 229/117.34
7,922,031 B1 4/2011 Prince
8,333,296 B1 12/2012 Fung
2003/0160055 A1 8/2003 Stewart-Stand
2005/0103834 A1 5/2005 Cousins
2008/0035715 A1 2/2008 Abler
2010/0230407 A1 9/2010 Savage
2013/0140305 A1 6/2013 Hollis
2014/0103036 A1 4/2014 Perlman

OTHER PUBLICATIONS

Tim Johnson Design, Inc., Geocup, website address: http://www.geocup.com, Tim Johnson Design, Inc., Boston, MA, USA, Dec. 3, 2015.
Collapse a Cup, Collapse a Cup, website address: http://www.collapse-a-cup.com, Collapse a Cup, Hamden, CT, USA, Dec. 3, 2015.
Nada Bottle, LLC., Nada Bottle, website address: https://www.nadabottle.com, Crested Butte, CO, USA, Dec. 3, 2015.
Niki Singlaub, Hydaway Bottle, website address: http://hydawaybottle.com/ Bend, Oregon, USA, Dec. 3, 2015.
Humangear, Inc., GoCup, website address: http://www.humangear.com/gocup/, San Francisco, CA, USA, Dec. 3, 2015.
Karla Zens, Zip Cup: Revolutionary Collapsible Coffee Cup, website address: http://www.zipcup.com, Dec. 3, 2015.
Ben Melinger, Stojo the Collapsible Pocket Cup, website address: http://www.stojo.co, Brooklyn, NY, USA, Dec. 3, 2015.
United States Patent & Trademark Office, International Search Report and Written Opinion,PCT/ISA/220, Application No. PCT/US2015/063784, Feb. 11, 2016, U.S. Patent & Trademark Office, Alexandria, VA.

* cited by examiner

COLLAPSIBLE RECEPTACLE

This application claims benefit of provisional application Ser. No. 62/087,783 filed Dec. 4, 2014.

FIELD OF THE INVENTION

The present invention relates generally to vessels. Stated more particularly, disclosed herein is a collapsible receptacle, such as a beverage cup, with an expanded, use configuration and a collapsed configuration.

BACKGROUND OF THE INVENTION

Innumerable disposable and non-disposable beverage cups are used every day. Disposable cups are typically limited to one or perhaps a few uses and then are normally discarded as waste. While useful, such cups are decidedly unfriendly to the environment and may simply be unavailable when needed. Non-disposable cups, such as plastic and glass vessels, can be cleaned and reused indefinitely, but it is not practical or convenient to carry and store them during travel. In both cases, beverage cups of the prior art are demonstrably limited in their portability, availability, and convenience.

It has thus been appreciated that a need exists for a cup that can be stored and transported conveniently, that can be rendered readily available, and that is reusable. There is a more particular need for a cup that can be folded or collapsed for storage and selectively reconfigured to an expanded, use configuration quickly, conveniently, and effectively. It is clear that a further need exists for such a foldable cup that is suitable for hot and cold beverages, that is durable, and that is easy to use.

In response to the foregoing shortcomings and needs, a number of inventors set about designing collapsible beverage cups. For instance, with U.S. Pat. No. 8,333,296, Duncan Fung disclosed a thermally insulated foldable cup for hot and cold beverages. Unfortunately, the cup of the '296 patent requires assembly, and it has external caps and straps that cannot be completely cleaned. Perhaps more importantly, the caps could become inadvertently dislodged at the risk of disastrous results.

Other prior art collapsible cups likewise present a risk of unintended collapsing, which can lead not only to a loss of the retained beverage or other material but also mess, inconvenience, and potential physical harm from hot beverages and the like. Moreover, many known collapsible cups are simply too bulky when in a collapsed configuration. Still further, collapsible cups of the prior art can be challenging to clean and difficult to adjust between collapsed and open configurations. Collapsible cups that are hard to clean and dry lead to poor hygienic results, foul tastes, and leakage in the user's pocket or storage area. Further still, collapsible cups of the prior art are rarely elegant in appearance and do not even approximate the appearance of a traditional cup. With that, they can be off-putting to a typical consumer. While some collapsible cups taught by the prior art seek to address one or more of these issues, no known collapsible cup of the prior art has successfully remedied these several challenges simultaneously.

With a knowledge of the foregoing, the present inventors appreciate that there remains a need for a collapsible beverage cup that overcomes the foregoing disadvantages.

SUMMARY OF THE INVENTION

In view of the state of the art and the limitations and deficiencies of current beverage cups as summarized above, the present inventors set forth with the basic object of providing a collapsible beverage cup that can be selectively reconfigured from a collapsed configuration for storage and an expanded, use configuration in a quick, convenient, and effective manner.

A further object of the invention is to provide a collapsible beverage cup that can be stored and transported conveniently, that can be rendered readily available, and that is reusable.

In certain embodiments, another object of the invention is to provide a collapsible beverage cup that is durable and easy to use and that can retain both hot and cold beverages.

Still another object of embodiments of the invention is to provide a collapsible beverage cup that resists inadvertent collapsing.

An underlying goal of the invention is to provide a collapsible beverage cup that can seal residual moisture and protect drinking surfaces from contamination.

Yet another object of embodiments of the invention is to provide a collapsible beverage cup that can be readily cleaned.

In certain embodiments of the invention, a further object is to provide a collapsible beverage cup that can be stored and even compressed and bent with no damage to the cup.

A further object of embodiments of the invention is to provide a cup that approximates the look and feel of a traditional cup while permitting the performance characteristics of a collapsible and expandable cup.

These and further objects and advantages of embodiments of the invention will become obvious not only to one who reviews the present specification but also to one who has an opportunity to make use of an embodiment of the collapsible beverage cup disclosed herein. It will be appreciated, however, that, although the accomplishment of each of the foregoing objects in a single embodiment of the invention may be possible and indeed preferred, not all embodiments will seek or need to accomplish each and every potential object and advantage. Nonetheless, all such embodiments should be considered within the scope of the invention.

In carrying forth one or more objects of the invention, a basic embodiment of the invention comprises a collapsible receptacle, which could be a beverage cup, that is reconfigurable between an expanded configuration with an open inner volume for retaining a volume of material and a collapsed configuration. The collapsible receptacle has an inner sleeve with first and second opposed major walls divided by opposed fold lines and an outer sleeve with first and second opposed major walls divided by opposed fold lines. A liner is retained by the inner and outer sleeves. The receptacle so formed can be retained in an expanded configuration with an open inner volume defined by the liner when the opposed fold lines of the inner sleeve are not aligned with the opposed fold lines of the outer sleeve, and the receptacle can be reconfigured to a collapsed configuration when the opposed fold lines of the inner sleeve and the outer sleeve are aligned.

For avoidance of doubt, it should be understood that the liner could be a separate article from the inner sleeve and the outer sleeve, or it could be formed with one or the other of the sleeves, potentially as a single component. The liner could traverse entirely from and beyond one or both of the upper and lower ends of the sleeves, or it could traverse over only a portion of one or both sleeves. The liner could even merely project beyond one of the sleeves, such as by having a proximal portion thereof fixed to a lower end of the inner sleeve and a distal portion thereof that defines an open inner volume.

Embodiments of the collapsible receptacle can further include a lid structure removably and replaceably engageable with the liner to enclose the open inner volume. Where such a lid structure is provided, the liner could incorporate a retaining ring disposed on the liner for engaging and retaining the lid structure.

The inner and outer sleeves can, for instance, be generally cylindrical with open upper and lower ends when the receptacle is in an expanded configuration. Moreover, while they could be otherwise formed, the opposed fold lines of the inner and outer sleeves could be longitudinally disposed. Embodiments of the receptacle are contemplated wherein the opposed fold lines of the inner and outer sleeves comprise living hinges.

In certain embodiments, the opposed fold lines of the outer sleeve could be disposed in groups with at least two fold lines to a first side of the outer sleeve and at least two fold lines to a second side of the outer sleeve opposite the first side. With that, the outer sleeve would have opposed minor walls. It is further within the scope of the disclosure for there to be at least three lines in each group of opposed fold lines of the outer sleeve so that the outer sleeve would have first and second minor walls to the first side of the outer sleeve and first and second minor walls to the second side of the outer sleeve. Additionally or alternatively, the opposed fold lines of the inner sleeve could be disposed in groups with at least two fold lines to a first side of the inner sleeve and at least two fold lines to a second side of the inner sleeve opposite the first side so that the inner sleeve has opposed minor walls. Furthermore, there could be at least three lines in each group of opposed fold lines of the inner sleeve such that the inner sleeve would have first and second minor walls to the first side of the inner sleeve and first and second minor walls to the second side of the inner sleeve.

It is additionally possible for the first and second major walls of at least the inner sleeve or the outer sleeve to taper in thickness from mid-portions of the first and second major walls toward the opposed fold lines. Still further, the inner sleeve and possibly the outer sleeve could be formed, such as by molding, in a substantially flat configuration. Also, it is contemplated that fastening formations could be disposed on the inner sleeve to assist in coupling the liner to the inner sleeve.

Embodiments of the collapsible receptacle could further include a rotation limiting formation on the inner sleeve and a rotation limiting formation on the outer sleeve with the rotation limiting formations preventing over-rotation of the inner sleeve relative to the outer sleeve. By way of example and not limitation, one rotation limiting formation could be at least one protuberance from the inner sleeve or the outer sleeve, and one rotation limiting formation could be a longitudinal extension portion from the other of the inner sleeve or the outer sleeve.

In other embodiments, the rotation limiting formation could comprise a slot in one of the sleeves, such as the inner sleeve, that guides the relative rotation of the sleeves and limits movement of the inner sleeve relative to the outer sleeve. Such a slot can limit relative rotation to approximately ninety degrees while retaining the sleeves so that the outer sleeve does not inadvertently dislodge from the inner sleeve. The outer sleeve can tighten up onto the inner sleeve by operation of the slot when the cup is reconfigured to an expanded configuration. The outer sleeve can, again by operation of the slot, loosen relative to the inner sleeve upon reconfiguration to a collapsed condition.

Under certain practices of the invention, the liner could be a flexible sleeve of material with sealed side edges, a sealed bottom edge, and an open top. Additionally, the liner can have a rim portion adjacent to the open top thereof. The rim portion can be coupled, for instance, to the inner sleeve, such as through fastening formations.

One will appreciate that the foregoing discussion broadly outlines the more important features of the invention merely to enable a better understanding of the detailed description that follows and to instill a better appreciation of the inventors' contribution to the art. Before an embodiment of the invention is explained in detail, it must be made clear that the following details and descriptions of inventive concepts are mere examples of the many possible manifestations of the invention.

DETAILED DESCRIPTION OF PREFERRED EMBODIMENTS

Figure 1:
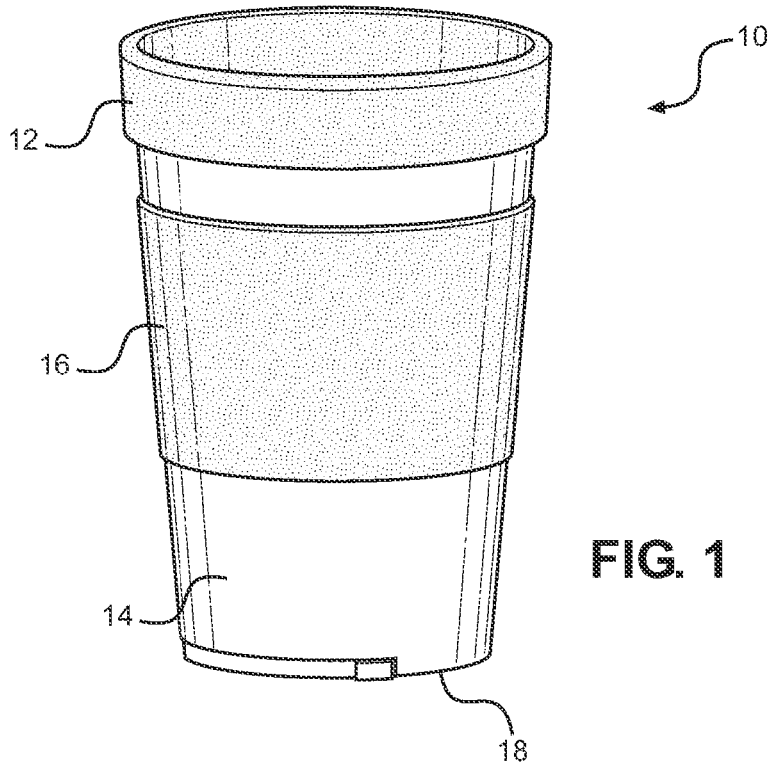
FIG. 1 is a perspective view of a collapsible beverage cup as taught herein in an expanded configuration.
Figure 2:
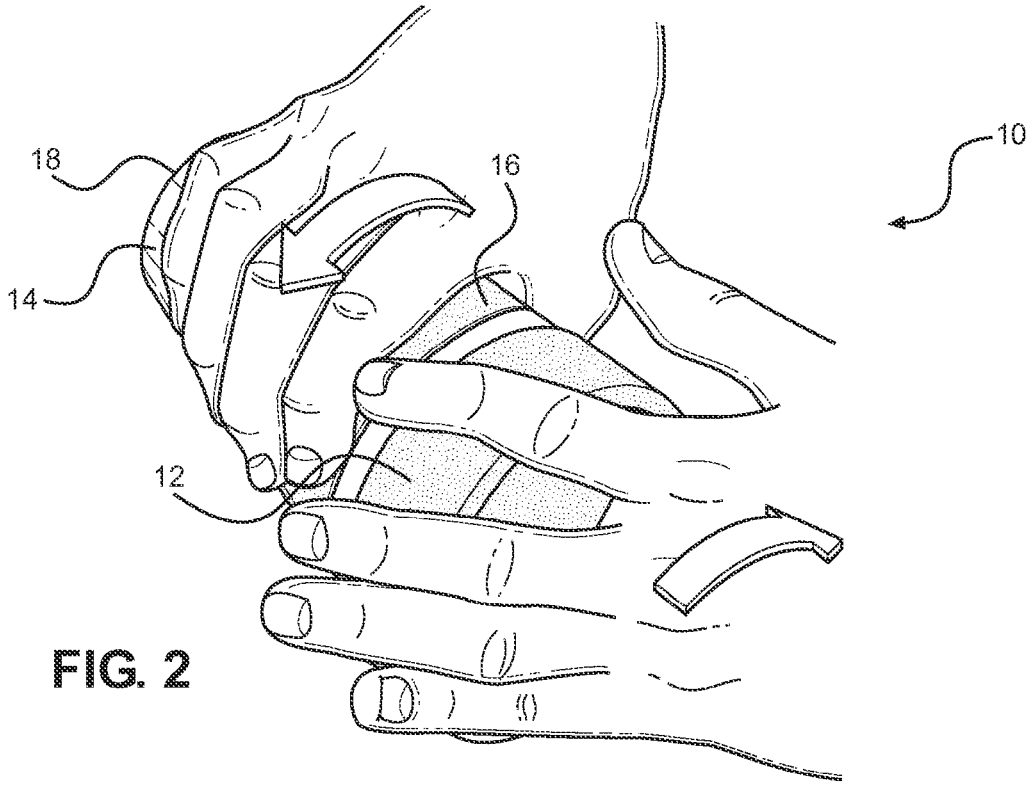
FIG. 2 is a further perspective view of a cup of FIG. 1 in an expanded configuration in the process of being gripped for reconfiguration.
Figure 3:
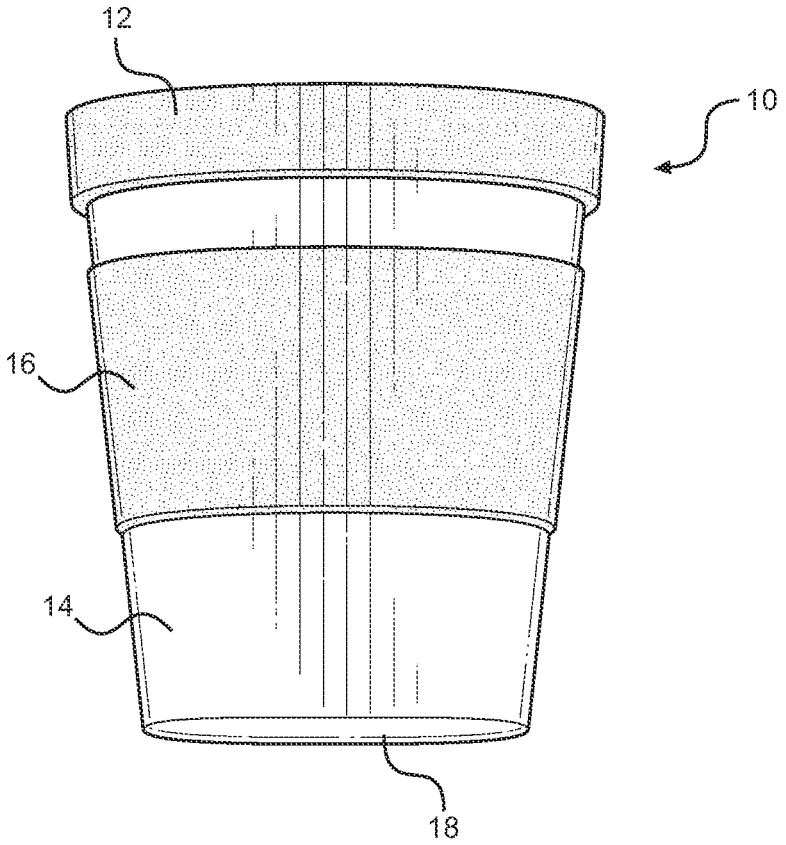
FIG. 3 is a perspective view of a cup of FIG. 1 in a collapsed position.
Figure 4:
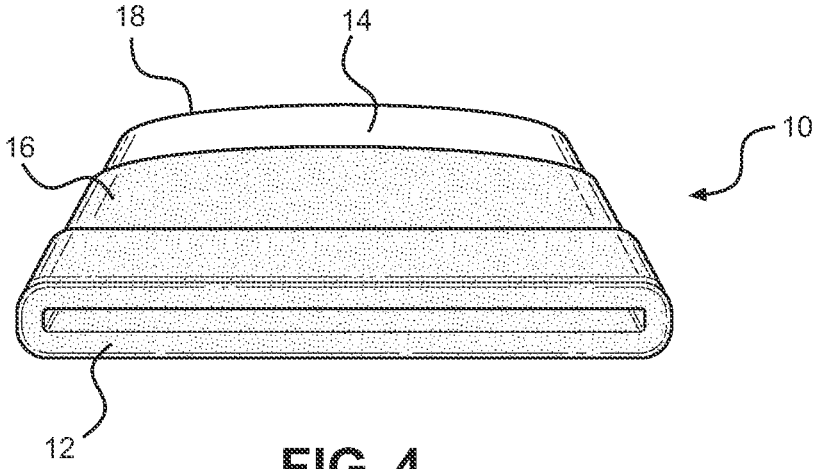
FIG. 4 is a further perspective view of a cup of FIG. 1 in a collapsed position.

The collapsible beverage cup disclosed herein is subject to varied embodiments, each within the scope of the invention. However, to ensure that one skilled in the art will be able to understand and, in appropriate cases, practice the present invention, certain preferred embodiments of the broader invention revealed herein are described below.

Looking more particularly to the drawings, a collapsible beverage cup according to the present invention is indicated generally at 10 in FIGS. 1 through 11. The collapsible beverage cup 10 is reconfigurable between an expanded or use configuration as shown, for instance, in FIG. 1 and a collapsed configuration as shown, for instance, in FIGS. 3 and 4. As can be perceived perhaps most clearly with reference to FIGS. 1 through 4 in combination with FIG. 9, the collapsible beverage cup 10 has a liner 12 that is matingly received into a sleeve combination formed by an inner sleeve 18 that is rotatably and generally concentrically engaged with an outer sleeve 14. As in the depicted embodiment, a grip sleeve 16 can be disposed to surround or partially surround the sleeve combination formed by the inner and outer sleeves 18 and 14, but other manifestations of the beverage cup 10 might forego a grip sleeve 16. A lid structure 46 can be engaged with the liner 12 or otherwise in relation to the cup 10 to selectively seal an open inner volume defined by the liner 12 when the cup 10 is in an expanded configuration.

When expanded, the sleeves 14, 16, and 18 could be generally cylindrical and can have corresponding shapes. The sleeves 14, 16, and 18 could be frusto-conical, consistent cylinders, or otherwise shaped. Each sleeve 14, 16, and 18 can have an open upper end and an open lower end. The inner and outer sleeves 18 and 14 can be made of the same or different materials. In certain embodiments, for instance, the inner and outer sleeves 18 and 14 could be crafted from a polymeric material. For instance, the inner and outer sleeves 18 and 14 could be formed from a thermoplastic polymer, such as polypropylene (pp).

Figure 19:
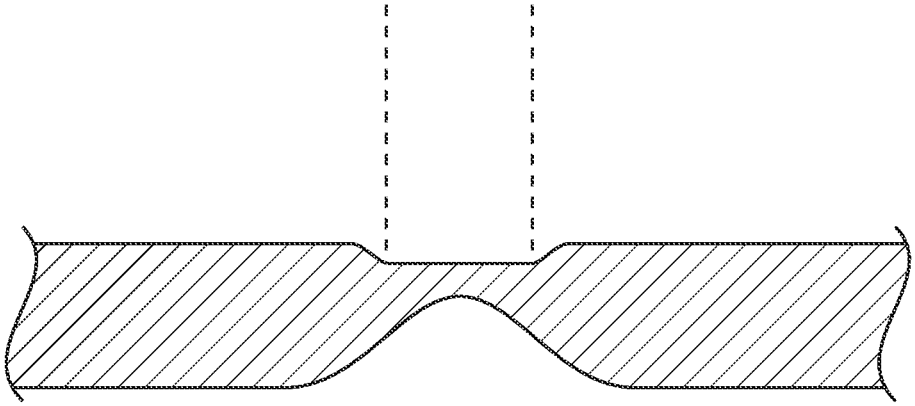
FIG. 19 is an amplified view of a living hinge as may form the fold lines of the collapsible beverage cup.

The outer sleeve 14 has longitudinal fold lines 42 disposed on opposed sides thereof in general opposition so that the outer sleeve 14 can be adjusted from a generally cylindrical configuration to a generally flat configuration. The fold lines 42, which can be substantially parallel, could comprise living hinges as shown, for instance, in FIG. 19. One fold line 42 could be provided, or two fold lines 42 might be employed as is illustrated so that first and second opposed major walls 38 have interposed minor walls 40 disposed in opposite sides thereof in general opposition. Embodiments are contemplated with three spaced fold lines 42 in each group of fold lines 42. Where three fold lines 42 are provided in each group, the outer sleeve 14 would be divided into first and second opposed major walls 38 with interposed first and second minor walls 40 disposed in opposition. As is illustrated, the major walls 38 of the outer sleeve 14 can have thickened mid-portions that taper along the circumference of the outer sleeve 14 from the mid-portions toward the fold lines 42.

The inner sleeve 18 can similarly have longitudinal fold lines 32 disposed in general opposition. With that, the inner sleeve 18 can be adjusted from a generally cylindrical configuration to a generally flat configuration. The fold lines 32, which can be substantially parallel, could comprise living hinges. One fold line 32 could be provided, or two fold lines 32 might be employed as is illustrated so that first and second opposed major walls 28 have interposed minor walls 30 disposed in opposite sides thereof in general opposition. Embodiments are contemplated with three spaced fold lines 32 in each group of fold lines 32. With that, the inner sleeve 18 would be divided into first and second opposed major walls 28 with interposed first and second minor walls 30 disposed in opposite sides thereof in general opposition. The major walls 28 of the inner sleeve 18 can have thickened mid-portions that taper along the circumference of the inner sleeve 18 from the mid-portions toward the fold lines 32.

It is contemplated that the inner sleeve 18 could be molded or otherwise formed flat as in the collapsed configuration so that the major walls 28 flex with tension to assist in retaining the inner sleeve 18 in position relative to the outer sleeve 14. In certain embodiments, the inner sleeve 18 can incorporate liner attachment holes 36 or other fastening formations to permit a fastening of the liner 12 in relation to the inner sleeve 18. It is further within the scope of the invention for the liner 12 and the inner sleeve 18 to be formed, such as by molding, as a unitary structure. Indeed, it would theoretically be possible for the liner 12 to be formed, again by molding or any other formation process, unitarily with the outer sleeve 14.

Figure 9:
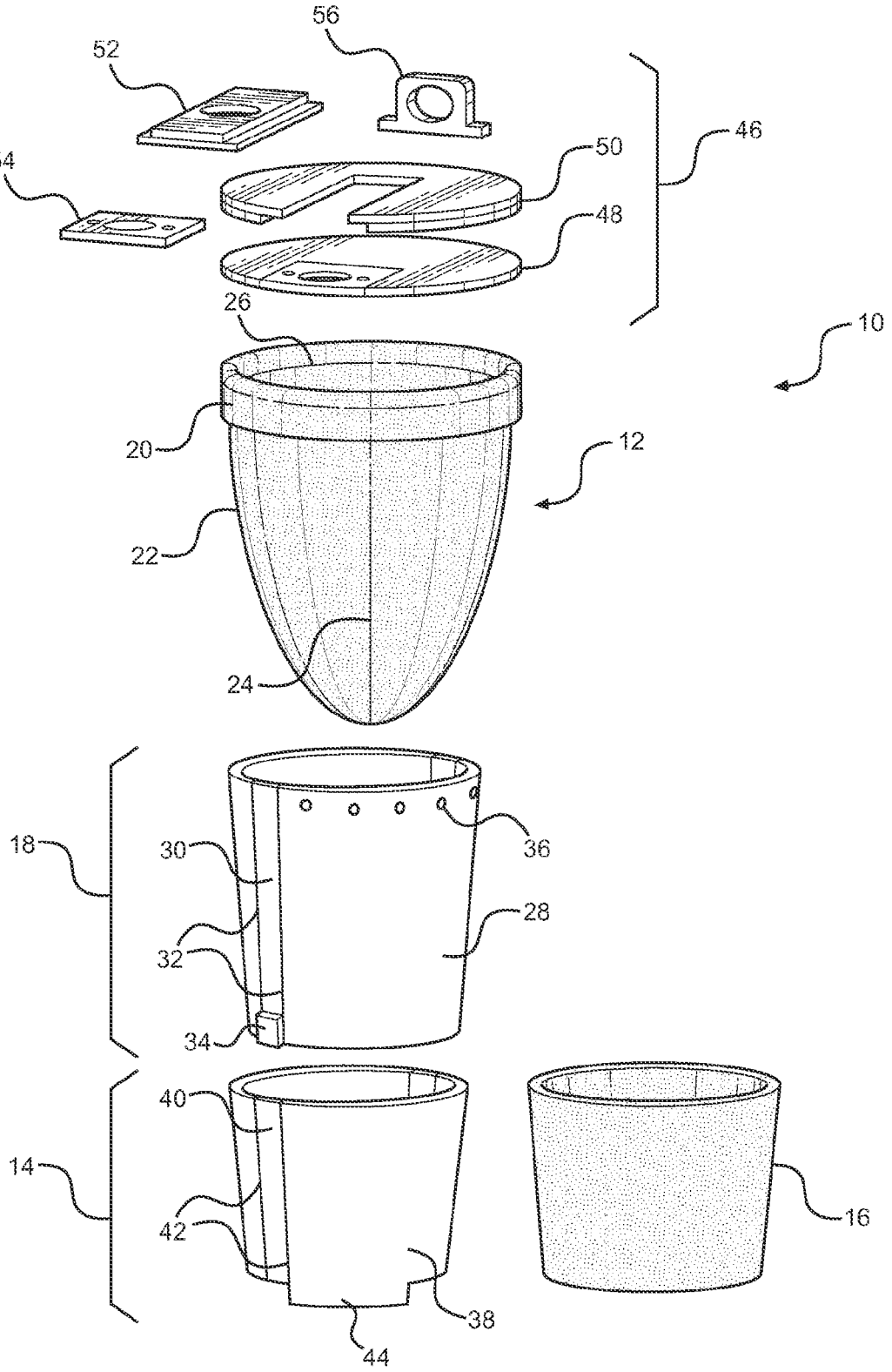
FIG. 9 is an exploded view of the collapsible beverage cup.
Figure 10:
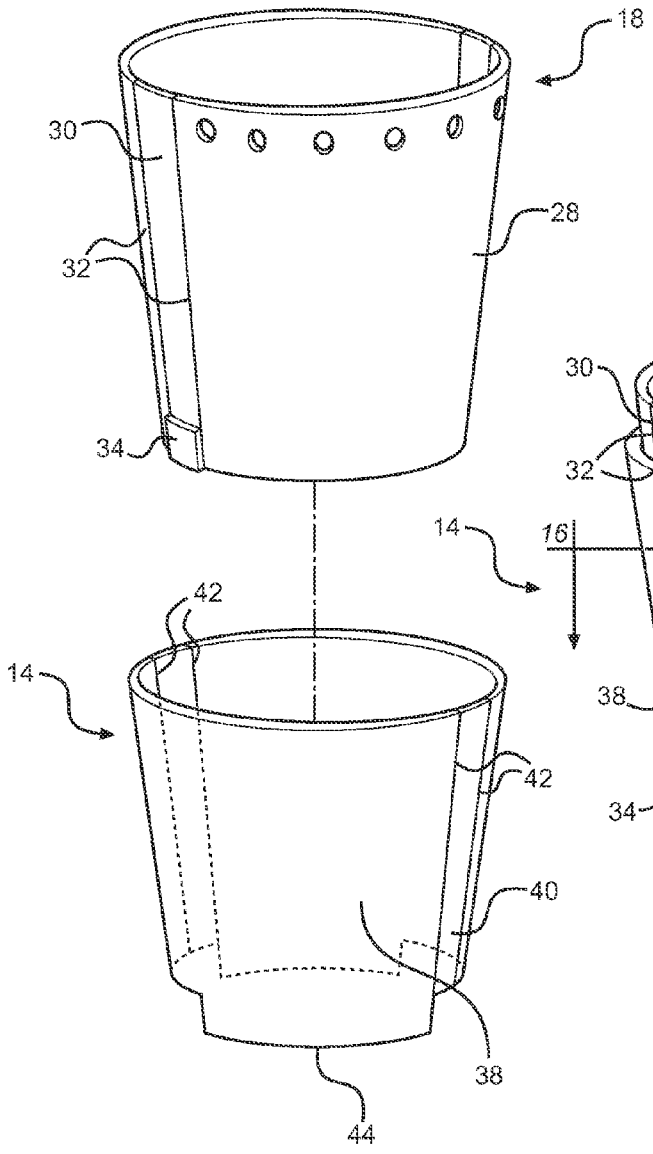
FIG. 10 is an exploded view of the inner sleeve and outer sleeve.
Figure 11:
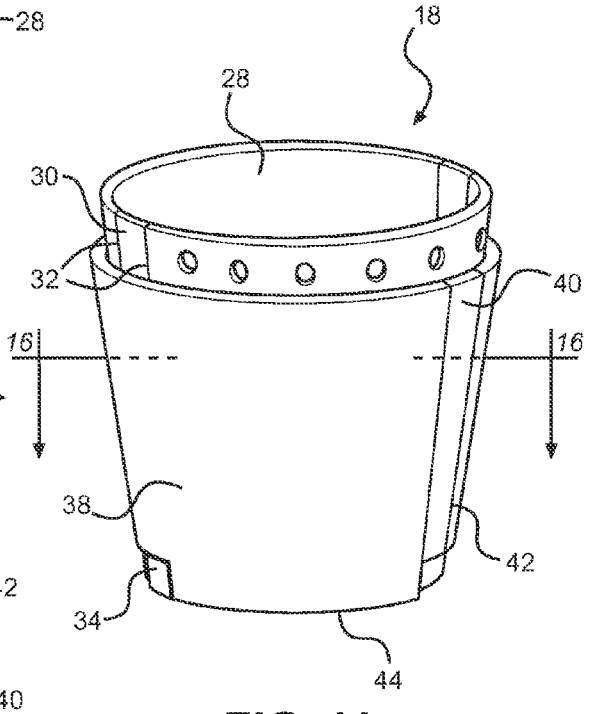
FIG. 11 is a view of the outer sleeve and the inner sleeve in an engaged configuration.
Figure 12:
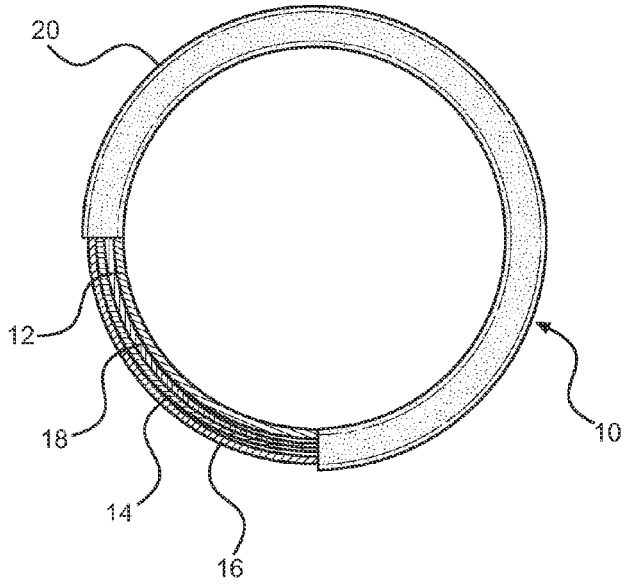
FIG. 12 is a partially sectioned top plan view of a collapsible beverage cup in an expanded configuration.
Figure 14:
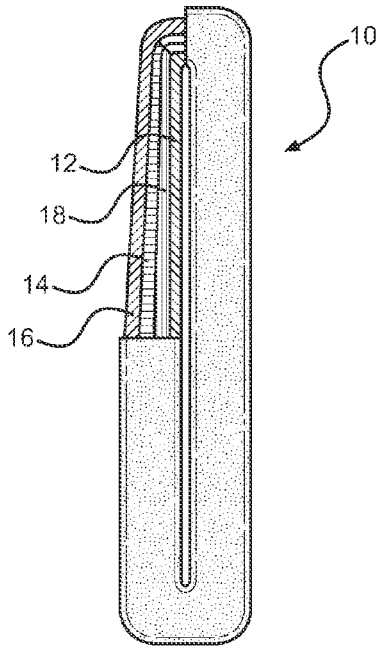
FIG. 14 is a partially sectioned top plan view of the collapsible beverage cup in a collapsed configuration.
Figure 13:
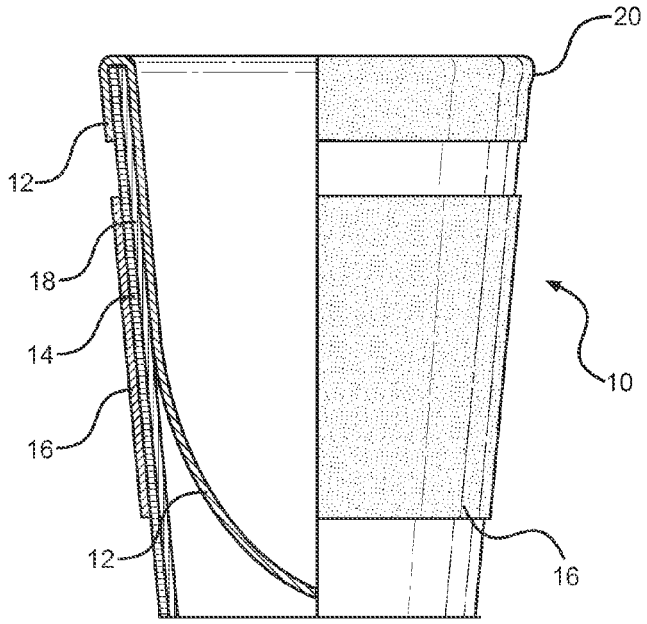
FIG. 13 is a partially sectioned view in side elevation of the collapsible beverage cup in an expanded configuration.
Figure 15:
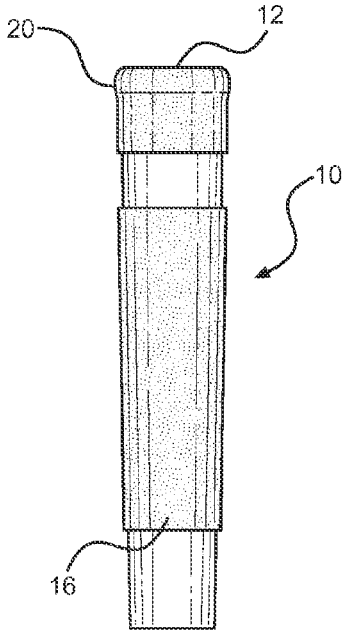
FIG. 15 is a view in side elevation of the collapsible beverage cup in a collapsed configuration.
Figure 16:
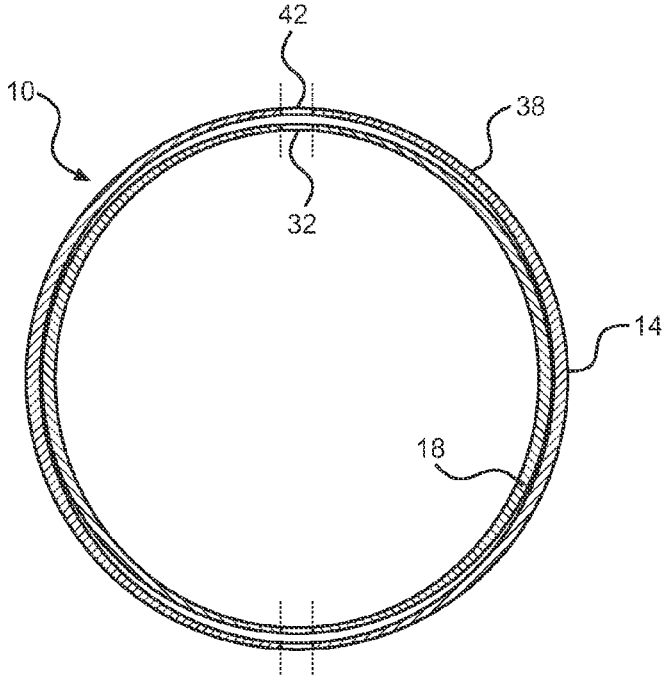
FIG. 16 is a sectioned top plan view of the collapsible beverage cup taken along the line 16-16 in FIG. 11, but with the inner and outer sleeves positioned for collapsing the cup.
Figure 17:
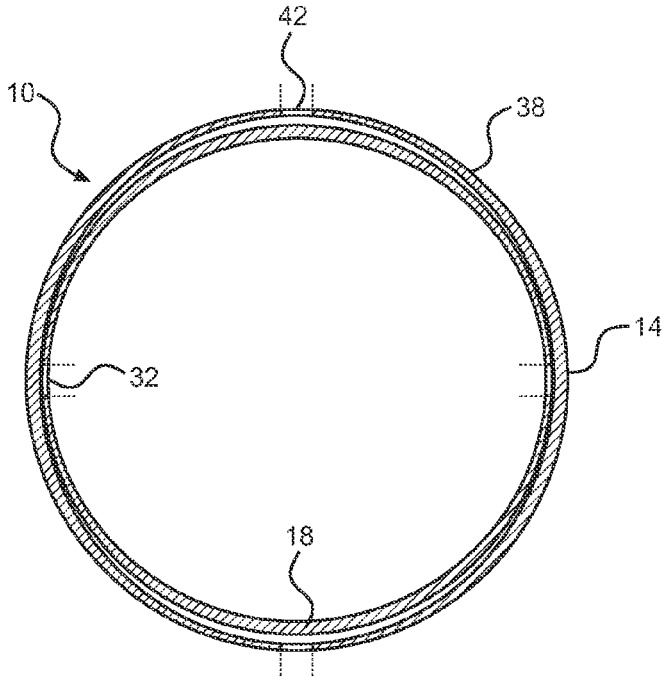
FIG. 17 is a sectioned top plan view of the collapsible beverage cup.
Figure 18:
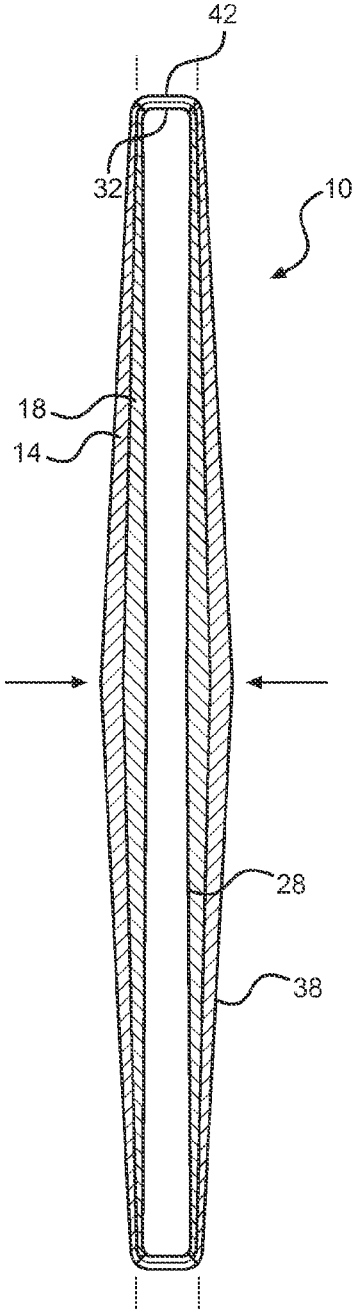
FIG. 18 is a sectioned top plan view of the collapsible beverage cup taken along the line 16-16 in FIG. 16 with the fold lines of the inner and outer sleeves rotated to maintain an expanded configuration.

The inner and outer sleeves 18 and 14 can incorporate a rotation limiting structure to prevent over-rotation of the inner sleeve 18 relative to the outer sleeve 14. For instance, as seen in FIG. 9, the inner sleeve 18 can have one or more retaining protuberances 34 that project therefrom, such as radially outward. In the depicted embodiment, there are first and second retaining protuberances 34 that project from a bottom portion of a minor wall 30 to each side of the inner sleeve 18. The outer sleeve 14 could have a longitudinal extension portion 44 that extends from the lower portion thereof. A delimited channel is formed in the outer sleeve 14 between the ends of the longitudinal extension portion 44. With that, the inner and outer sleeves 18 and 14 can be rotated over a given angular rotation, such as over a ninety degree interval, from a first relative orientation where a protuberance 34 contacts a first end of the longitudinal extension portion 44 at a first end of the delimited channel to a second relative orientation where a protuberance 34 contacts a second end of the longitudinal extension portion 44 at a second end of the delimited channel. It will be understood, of course, that the protuberance or protuberances 34 and the delimited channel or longitudinal extension portion 44 could be oppositely disposed or differently configured within the scope of the invention.

In other embodiments, for example, the delimited channel, which again comprises a rotation limiting formation, can be formed as a slot in one of the sleeves 14 and 18, such as the inner sleeve 18, that guides the relative rotation of the sleeves 14 and 18 and limits movement of the inner sleeve 18 relative to the outer sleeve 14. A protuberance could be provided on the other sleeve 14 or 18. Such a slot can limit relative rotation to approximately ninety degrees while retaining the sleeves 14 and 18 so that the outer sleeve 14 does not inadvertently dislodge from the inner sleeve 18. The outer sleeve 14 can tighten up onto the inner sleeve 18 by operation of the slot when the cup 10 is reconfigured to an expanded configuration. The outer sleeve 14 can, again by operation of the slot, loosen relative to the inner sleeve 18 upon reconfiguration to a collapsed condition.

As seen, for instance, in FIGS. 7A through 9, the liner 12 can be a flexible, tubular sleeve of material with sealed side edges, a sealed bottom edge, and an open top. With that, a liquid-tight inner volume is defined when the liner 12 is in an open or expanded configuration as, for instance, in FIGS. 8A and 8B. In the depicted embodiment, the liner 12 has first and second opposed sidewalls 22 joined along three edges at a fold line 24, which could be a seam where the sidewalls 22 meet whether by being joined or by integral formation. The sidewalls 22 can be formed to have a bias to a bulbous or bulged condition, such as is shown most clearly in FIGS. 7A and 7B. The liner 12 can be characterized as a flexible bag.

The liner 12 can have a folded over rim portion 20, which may alternatively be referred to as an overturned band 20. The overturned band 20 can be attached to or merely retained by the inner sleeve 18. The liner 12 can further include a retaining ring 26, which could be a raised ridge as shown or a furrow or some other formation, that encircles the inner surface thereof adjacent to the mouth of the liner 12. With that, the lid structure 46 can be selectively locked in place relative to the liner 12 and the cup 10 in general when the cup 10 is in an expanded configuration. The liner 12 could be formed from any suitable material or materials. The liner 12 can be waterproof. In certain practices of the invention, the liner 12 could, for example, be formed from a thermoplastic polymer, from rubber, such as a food grade silicone, or from any other material.

Figure 5:
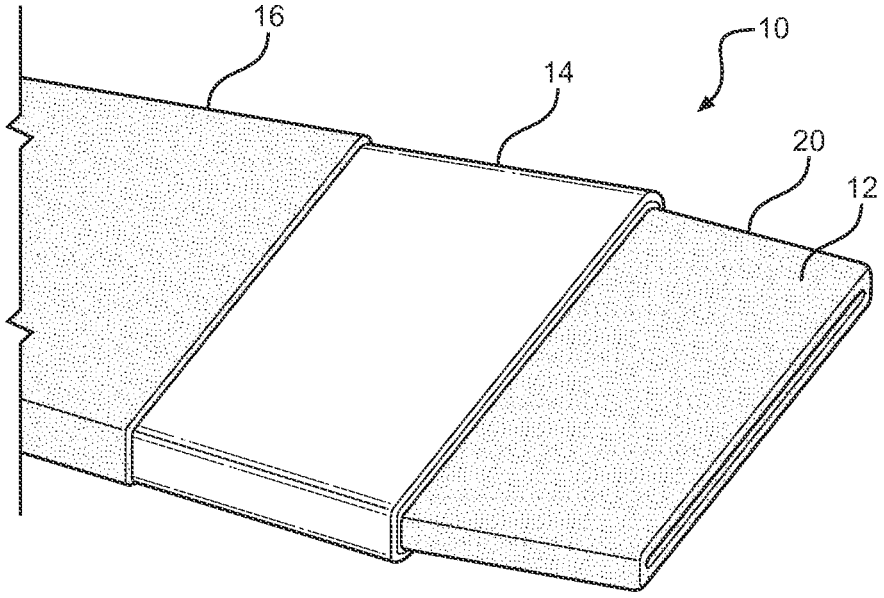
FIG. 5 is an amplified perspective view of the inner and outer sleeves of the collapsible beverage cup with the rim of the liner in an unfolded position.
Figure 6:
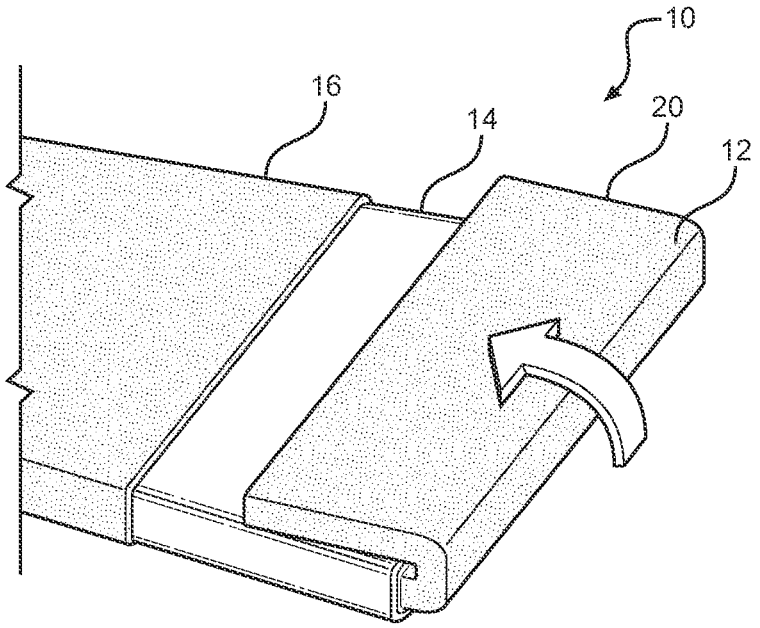
FIG. 6 is an amplified perspective view of the inner and outer sleeves of the collapsible beverage cup with the rim of the liner flapped over the end of the cup.
Figure 7A:
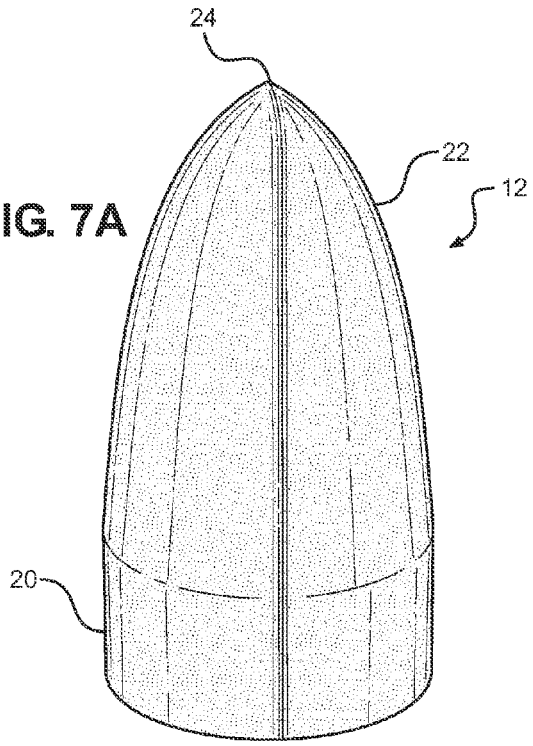
FIGS. 7A and 7B are views in side elevation of the liner of the collapsible beverage cup with the rim thereof unfolded and folded over respectively.
Figure 7B:
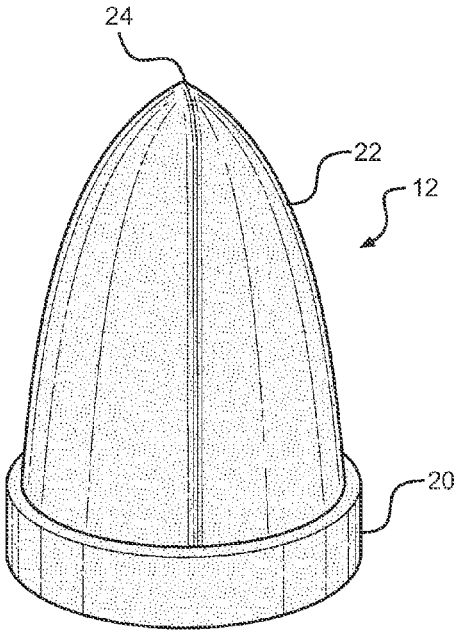
Figure 8A:
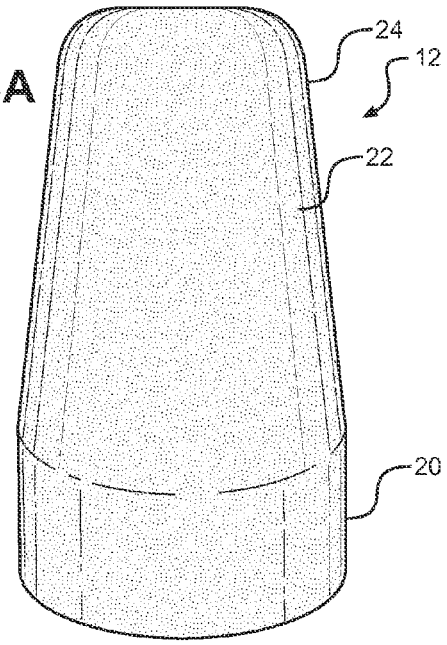
FIGS. 8A and 8B are views in front elevation of the liner of the collapsible beverage cup with the rim thereof unfolded and folded over respectively.
Figure 8B:
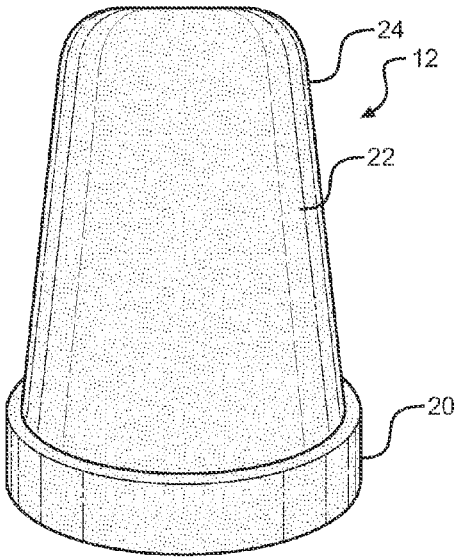

As shown, for instance, in FIG. 5, the rim 20 of the liner 12 can be extended or effectively uncuffed to an unfolded position. With that, when the cup 10 is in a collapsed configuration, the rim 20 of the liner 12 can be flapped over the end of the cup 10 as seen, for example, in FIG. 6. A further understanding of the folded and unfolded configurations of the rim 20 of the liner 12 can be had with reference to FIGS. 7A through 8B.

Figure 20:
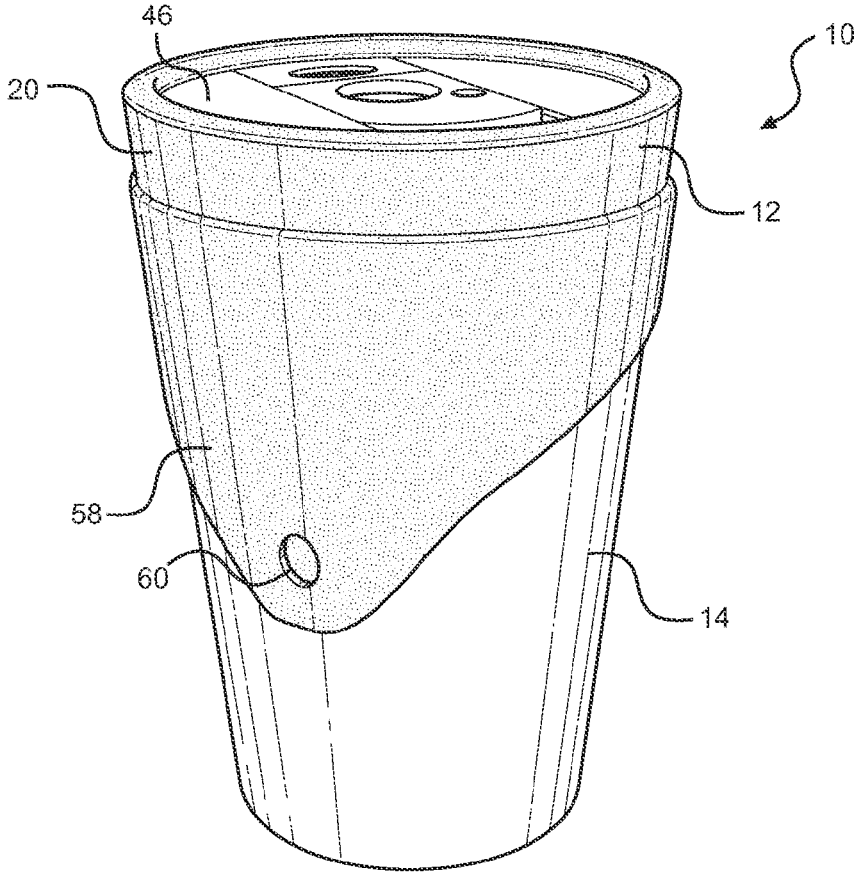
FIG. 20 is a perspective view of an alternative the collapsible beverage cup with a flap according to the invention in an expanded configuration.
Figure 21:
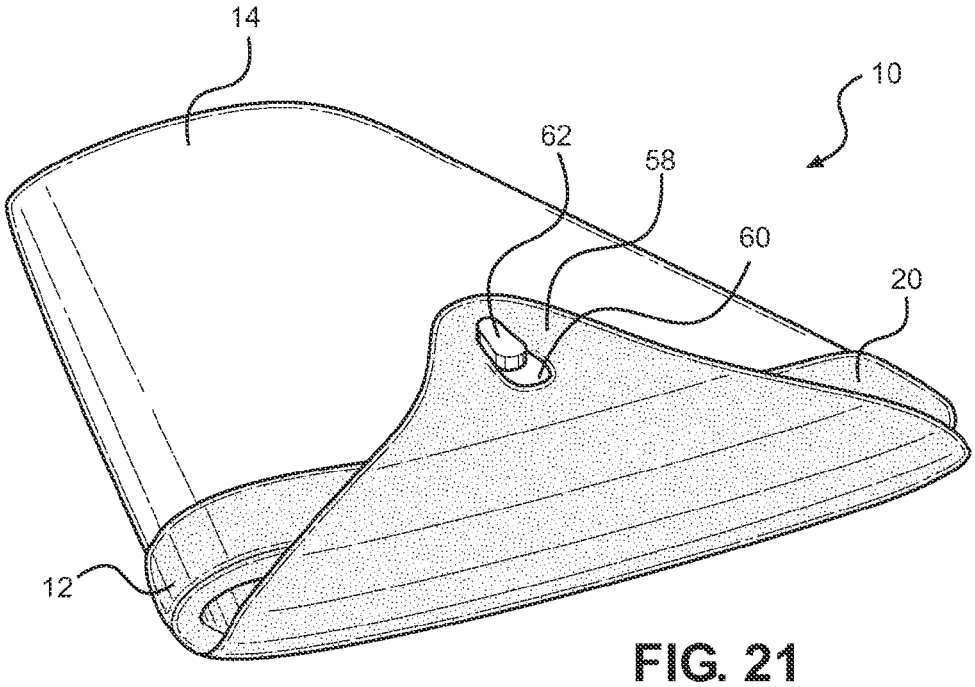
FIG. 21 is a perspective view of an alternative the collapsible beverage cup of FIG. 19 in a collapsed configuration and with the flap folded over.

Looking to FIGS. 20 and 21, embodiments of the collapsible beverage cup 10 could incorporate a flap 58 that can be disposed to lie against and conform to the outer sleeve 14 when the collapsible cup 10 is in an expanded configuration with the lid structure 46 closing the open top of the beverage cup 10 as in FIG. 20. Here, the flap 58 comprises an extension of the folded over rim portion 20 of the liner 12 and could thus be of the same material. When the collapsible cup 10 is adjusted to a collapsed configuration as in FIG. 21, the flap 58 can be folded over the top of the collapsed cup 10 thereby substantially to seal the inner volume of the liner 12. For instance, residual moisture within the liner 12 tends to be sealed into the collapsed cup 10, and exterior contaminants tend to be blocked from entering the collapsed liner 12.

As is illustrated, the collapsible cup 10 could have a retaining mechanism for selectively retaining the distal portion of the flap 58 against the outer sleeve 14. In the depicted embodiment, the retaining mechanism comprises a protuberance 62 disposed to receive and retain an aperture 60 in a distal portion of the flap 58. With that, the flap 58 can be selectively retained in the overlying configuration of FIG. 21. Of course, other retaining mechanisms are possible and within the scope of the invention except as they may be expressly excluded by the claims. For example, a hook and loop combination could be employed as could a button combination or any other effective retaining mechanism.

Moreover, the retained flap 58 can help keep the collapsible cup 10 flat and closed. Still further, the flap 58 and the aperture 60 could be used to hang the collapsible cup 10 on an external structure, such as on a hook of a bicycle (not shown). Additionally, particularly where the flap 58 is formed from an insulative material, the flap 58 can provide added insulation to the contents of the cup 10, and the flap 58 can assist with providing a better grip during use of the cup 10.

The lid structure 46 can be of any suitable construction. In this example of the invention, as shown, for instance, in FIG. 9, the lid structure 46 has a rigid, annular bottom disk 48 that is sized and shaped to engage the liner 12 and the retaining ring 26 thereof in a sealing engagement. The annular bottom disk 48 has an aperture therein that can be selectively opened and closed, such as by a combination of an upper disk 50, a slide member 52, and a gasket seal 54. Further, a lift tab 56 could be secured to the lid structure 46 to enable the selective manipulation thereof, including removal and installation of the lid structure 46 in relation to the liner 12.

Under this configuration, the collapsible beverage cup 10 can be quickly and conveniently reconfigured between an expanded, use configuration and a collapsed configuration. When the cup 10 is in a use configuration, the fold lines 32 and 42 of the inner and outer sleeves 18 and 14 are disposed out of alignment, such as by being spaced approximately ninety degrees apart. With that, the cup 10 is locked in a round, use configuration with an open inner volume established within the liner 12 for retaining, for instance, a beverage. The major walls 28 and 38, which again can have thickened mid-portions, operate to brace the fold lines 32 and 42 against folding when the fold lines 32 and 42 are out of alignment. The inner and outer sleeves 18 and 14 can be rotated, such as over a ninety degree interval, to bring the fold lines 32 and 42 into alignment as seen, for instance, in FIGS. 3 through 6, 14, and 17. With the fold lines 32 and 42 aligned, the cup 10 can be reconfigured to a collapsed configuration, such as for transport and storage.

It will be understood that the collapsible beverage cup 10 could include additional or fewer components, functions, or characteristics than those shown and described herein. Accordingly, although the foregoing components and arrangements of components may indeed be preferable and advantageous in achieving one or more objects of the invention, the collapsible beverage cup 10 shall not be interpreted to require all of the foregoing components, to be limited to the specified components, or to be limited even to the positioning and configuration of individual components except as the claims might expressly specify.

Therefore, with certain details and embodiments of the present invention for a collapsible beverage cup 10 disclosed, it will be appreciated by one skilled in the art that numerous changes and additions could be made thereto without deviating from the spirit or scope of the invention. This is particularly true when one bears in mind that the presently preferred embodiments merely exemplify the broader invention revealed herein. Accordingly, it will be clear that those with major features of the invention in mind could craft embodiments that incorporate those major features while not incorporating all of the features included in the preferred embodiments.

Therefore, the following claims shall define the scope of protection to be afforded to the inventors. Those claims shall be deemed to include equivalent constructions insofar as they do not depart from the spirit and scope of the invention. It must be further noted that a plurality of the following claims may express certain elements as means for performing a specific function, at times without the recital of structure or material. As the law demands, any such claims shall be construed to cover not only the corresponding structure and material expressly described in this specification but also all equivalents thereof.

We claim as deserving the protection of Letters Patent:

1. A collapsible receptacle reconfigurable between an expanded configuration for retaining a volume of material and a collapsed configuration, the collapsible receptacle comprising:

an inner sleeve with first and second opposed major walls divided by opposed fold lines;

an outer sleeve engaged with the inner sleeve wherein the outer sleeve has first and second opposed major walls divided by opposed fold lines; and a liner retained by the inner and outer sleeves;

wherein the receptacle can be retained in the expanded configuration with an open inner volume defined by the liner when the opposed fold lines of the inner sleeve are not aligned with the opposed fold lines of the outer sleeve and wherein the receptacle can be reconfigured to the collapsed configuration when the opposed fold lines of the inner sleeve and the outer sleeve are aligned and wherein the inner sleeve is formed in a substantially flat configuration.

2. A collapsible receptacle reconfigurable between an expanded configuration for retaining a volume of material and a collapsed configuration, the collapsible receptacle comprising:

an inner sleeve with first and second opposed major walls divided by opposed fold lines;

an outer sleeve engaged with the inner sleeve wherein the outer sleeve has first and second opposed major walls divided by opposed fold lines; and a liner retained by the inner and outer sleeves;

wherein the receptacle can be retained in the expanded configuration with an open inner volume defined by the liner when the opposed fold lines of the inner sleeve are not aligned with the opposed fold lines of the outer sleeve and wherein the receptacle can be reconfigured to the collapsed configuration when the opposed fold lines of the inner sleeve and the outer sleeve are aligned and wherein the first and second major walls of at least the inner sleeve or the outer sleeve taper in thickness from mid-portions of the first and second major walls toward the opposed fold lines.

3. A collapsible receptacle reconfigurable between an expanded configuration for retaining a volume of material and a collapsed configuration, the collapsible receptacle comprising:

an inner sleeve with first and second opposed major walls divided by opposed fold lines;

an outer sleeve engaged with the inner sleeve wherein the outer sleeve has first and second opposed major walls divided by opposed fold lines; and a liner retained by the inner and outer sleeves;

wherein the receptacle can be retained in the expanded configuration with an open inner volume defined by the liner when the opposed fold lines of the inner sleeve are not aligned with the opposed fold lines of the outer sleeve and wherein the receptacle can be reconfigured to the collapsed configuration when the opposed fold lines of the inner sleeve and the outer sleeve are aligned;

wherein the inner and outer sleeves are generally cylindrical with open upper and lower ends when the receptacle is in the expanded configuration and wherein the opposed fold lines of the inner and outer sleeves are substantially longitudinal.

4. The collapsible receptacle of claim 3 wherein the receptacle comprises a beverage cup.

5. The collapsible receptacle of claim 3 further comprising a lid structure removably and replaceably engageable with the liner to enclose the open inner volume.

6. The collapsible receptacle of claim 3 wherein the opposed fold lines of the inner and outer sleeves comprise living hinges.

7. The collapsible receptacle of claim 3 wherein the opposed fold lines of the outer sleeve are disposed in groups with at least two fold lines to a first side of the outer sleeve and at least two fold lines to a second side of the outer sleeve opposite the first side whereby the outer sleeve has opposed minor walls.

8. The collapsible receptacle of claim 7 wherein the opposed fold lines of the inner sleeve are disposed in groups with at least two fold lines to a first side of the inner sleeve and at least two fold lines to a second side of the inner sleeve opposite the first side whereby the inner sleeve has opposed minor walls.

9. The collapsible receptacle of claim 3 wherein the first and second major walls of at least the inner sleeve or the outer sleeve taper in thickness from mid-portions of the first and second major walls toward the opposed fold lines.

10. The collapsible receptacle of claim 3 wherein the opposed fold lines of the inner sleeve are disposed in groups with at least two fold lines to a first side of the inner sleeve and at least two fold lines to a second side of the inner sleeve opposite the first side whereby the inner sleeve has opposed minor walls.

11. The collapsible receptacle of claim 10 wherein the first and second major walls of at least the inner sleeve or the outer sleeve taper in thickness from mid-portions of the first and second major walls toward the opposed fold lines.

12. The collapsible receptacle of claim 3 further comprising fastening formations disposed on the inner sleeve and wherein the liner is coupled to the inner sleeve by the fastening formations.

13. The collapsible receptacle of claim 3 wherein the liner comprises a flexible sleeve of material with sealed side edges, a sealed bottom edge, and an open top.

14. The collapsible receptacle of claim 13 wherein the liner has a rim portion adjacent to the open top of the liner and wherein the rim portion is coupled to the inner sleeve.

15. The collapsible receptacle of claim 14 wherein the liner and the inner sleeve are formed as separate components.

16. The collapsible receptacle of claim 3 wherein the open inner volume has a top and further comprising a flap retained by the inner or outer sleeve wherein the flap can be disposed against the outer sleeve when the collapsible receptacle is in the expanded configuration and wherein the flap can be folded over the top of the open inner volume when the collapsible receptacle is in the collapsed configuration.

17. The collapsible receptacle of claim 16 wherein the flap comprises an extension of the liner.

18. The collapsible receptacle of claim 16 further comprising a retaining mechanism for selectively retaining the flap against the outer sleeve.

19. The collapsible receptacle of claim 3 wherein the inner sleeve and the outer sleeve are relatively rotatable from a first relative orientation wherein the opposed fold lines of the inner sleeve are not aligned with the opposed fold lines of the outer sleeve to a second relative orientation wherein the opposed fold lines of the inner sleeve are aligned with the opposed fold lines of the outer sleeve.

20. The collapsible receptacle of claim 19 wherein the first relative orientation and the second relative orientation are separated by approximately 90 degrees of rotation of the outer sleeve relative to the inner sleeve.

21. The collapsible receptacle of claim 3 wherein the opposed fold lines of the inner and outer sleeves are longitudinal.

22. A collapsible receptacle reconfigurable between an expanded configuration for retaining a volume of material and a collapsed configuration, the collapsible receptacle comprising:

an inner sleeve with first and second opposed major walls divided by opposed fold lines;

an outer sleeve engaged with the inner sleeve wherein the outer sleeve has first and second opposed major walls divided by opposed fold lines;

a liner retained by the inner and outer sleeves;

wherein the receptacle can be retained in the expanded configuration with an open inner volume defined by the liner when the opposed fold lines of the inner sleeve are not aligned with the opposed fold lines of the outer sleeve and wherein the receptacle can be reconfigured to the collapsed configuration when the opposed fold lines of the inner sleeve and the outer sleeve are aligned;

a lid structure removably and replaceably engageable with the liner to enclose the open inner volume; and a retaining ring disposed on the liner for engaging and retaining the lid structure.

23. A collapsible receptacle reconfigurable between an expanded configuration for retaining a volume of material and a collapsed configuration, the collapsible receptacle comprising:

an inner sleeve with first and second opposed major walls divided by opposed fold lines;

an outer sleeve rotatably engaged with the inner sleeve wherein the outer sleeve has first and second opposed major walls divided by opposed fold lines;

a liner retained by the inner and outer sleeves; and a rotation limiting formation on the inner sleeve and a rotation limiting formation on the outer sleeve wherein the rotation limiting formations prevent over-rotation of the inner sleeve relative to the outer sleeve;

wherein the receptacle can be retained in the expanded configuration with an open inner volume defined by the liner when the opposed fold lines of the inner sleeve are not aligned with the opposed fold lines of the outer sleeve and wherein the receptacle can be reconfigured to the collapsed configuration when the opposed fold lines of the inner sleeve and the outer sleeve are aligned.

24. The collapsible receptacle of claim 23 wherein one rotation limiting formation comprises at least one protuberance from the inner sleeve or the outer sleeve and wherein one rotation limiting formation comprises a delimited channel on the other of the inner sleeve or the outer sleeve.

25. A collapsible beverage cup that is reconfigurable between an expanded configuration for retaining a volume of material and a collapsed configuration, the collapsible beverage cup comprising:

an inner sleeve with first and second opposed major walls divided by opposed, longitudinal fold lines;

an outer sleeve engaged with the inner sleeve wherein the outer sleeve has first and second opposed major walls divided by opposed, longitudinal fold lines wherein the opposed fold lines of the outer sleeve are disposed in groups with at least two fold lines to a first side of the outer sleeve and at least two fold lines to a second side of the outer sleeve opposite the first side whereby the outer sleeve has opposed minor walls; and a liquid-tight liner retained by the inner and outer sleeves;

wherein the beverage cup can be retained in the expanded configuration with an open inner volume defined by the liner when the opposed fold lines of the inner sleeve are not aligned with the opposed fold lines of the outer sleeve and wherein the beverage cup can be reconfigured to the collapsed configuration when the opposed fold lines of the inner sleeve and the outer sleeve are aligned.

26. The collapsible beverage cup of claim 25 wherein the opposed fold lines of the inner sleeve are disposed in groups with at least two fold lines to a first side of the inner sleeve and at least two fold lines to a second side of the inner sleeve opposite the first side whereby the inner sleeve has opposed minor walls.

27. The collapsible beverage cup of claim 25 wherein the first and second major walls of at least the inner sleeve or the outer sleeve taper in thickness from mid-portions of the first and second major walls toward the opposed fold lines.

* * * * *